US008807674B2

(12) United States Patent
Okawa

(10) Patent No.: US 8,807,674 B2
(45) Date of Patent: Aug. 19, 2014

(54) LIQUID DROPLET EJECTING APPARATUS

(75) Inventor: Yasuo Okawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 786 days.

(21) Appl. No.: 12/981,237

(22) Filed: Dec. 29, 2010

(65) Prior Publication Data

US 2011/0187768 A1 Aug. 4, 2011

(30) Foreign Application Priority Data

Jan. 29, 2010 (JP) ..... 2010-018891

(51) Int. Cl.
*B41J 29/38* (2006.01)

(52) U.S. Cl.
USPC ..... 347/5

(58) Field of Classification Search
USPC ..... 347/5
See application file for complete search history.

(56) References Cited

U.S. PATENT DOCUMENTS

| | | | | |
|---|---|---|---|---|
| 5,541,628 | A | 7/1996 | Chang et al. | |
| 2004/0189742 | A1 | 9/2004 | Kimura et al. | |
| 2005/0062797 | A1 * | 3/2005 | Kachi | 347/33 |
| 2008/0049066 | A1 | 2/2008 | Inoue | |

FOREIGN PATENT DOCUMENTS

| | | | |
|---|---|---|---|
| JP | H11-300966 | A | 11/1999 |
| JP | 2002-225298 | A | 8/2002 |
| JP | 2003-001857 | A | 1/2003 |
| JP | 2004-291618 | A | 10/2004 |
| JP | 2006-044163 | A | 2/2006 |
| JP | 2006044163 | A * | 2/2006 |
| JP | 2006-224435 | A | 8/2006 |
| JP | 2006-247956 | A | 9/2006 |
| JP | 2008-049535 | A | 3/2008 |
| JP | 2009-137210 | A | 6/2009 |

OTHER PUBLICATIONS

Japan Patent Office, Notice of Reason for Rejection for Japanese Patent Application No. 2010-018891 (counterpart Japanese patent application), mailed Jan. 8, 2013.

* cited by examiner

*Primary Examiner* — Uyen Chau N Le
*Assistant Examiner* — Hoang Tran
(74) *Attorney, Agent, or Firm* — Baker Botts L.L.P.

(57) ABSTRACT

A liquid droplet ejecting apparatus includes a droplet ejection head, an absorber, a moving mechanism, and a controller. The droplet ejection head includes liquid passages having at their leading ends ejection openings which eject droplets, an ejection face which faces a recording medium onto which droplets ejected from the ejection openings are placed, and an actuator which applies energy to liquid inside the liquid passages. The absorber includes a liquid-absorbent facing portion which faces the ejection openings when the absorber faces the ejection face. The moving mechanism moves the droplet ejection head and the absorber relatively to each other such that the droplet ejection head and the absorber are positioned in an absorbing position where the ejection openings and the facing portion face each other. The controller controls the moving mechanism to position the droplet ejection head and the absorber in the absorbing position, and while the droplet ejection head and the absorber are positioned in the absorbing position, controls the actuator to apply to the liquid in the liquid passages energy falling short for droplet ejection from each of the ejection openings thereby having a meniscus formed on each of the ejection openings contact the facing portion.

6 Claims, 12 Drawing Sheets

LIQUID DROPLET EJECTING APPARATUS

CROSS REFERENCE TO RELATED APPLICATION

This application claims priority from Japanese Patent Application No. 2010-018891, which was filed on Jan. 29, 2010, the disclosure of which is herein incorporated by reference in its entirety.

BACKGROUND OF THE INVENTION

1. Field of the Invention

The present invention relates to a liquid droplet ejecting apparatus which ejects liquid droplets such as ink droplets.

2. Description of Related Art

For maintaining the quality of recording in an inkjet recording apparatus which is an exemplary liquid droplet ejecting apparatus, an operations to recover the ejection performance is performed to solve or restrain thickening of ink inside heads. Examples of such an operation include ejection flushing and non-ejection flushing. The ejection flushing is an operation of forcedly ejecting ink droplets from ejection openings, while facing the heads to caps, a conveyor belt, a sheet, or the like. The non-ejection flushing on the other hand is an operation for vibrating menisci formed at the ejection openings, without ejection of ink droplets from the ejection openings.

SUMMARY OF THE INVENTION

By vibrating the each meniscus through the non-ejection flushing, the thickened ink inside the ejection opening is dispersed, and the viscosity of the ink is temporarily reduced. However, the thickened ink accumulated in the head is not discharged. For this reason, to prevent ejection defects, the ejection flushing is performed, in addition to the non-ejection flushing, to discharge the thickened ink from the heads. This ejection flushing however requires a large ink consumption volume and is uneconomic.

An object of the present invention is to provide a liquid droplet ejecting apparatus whose liquid consumption volume related to recovery of ejection performance is restrained.

With the present invention, there is provided a liquid droplet ejecting apparatus including a droplet ejection head, an absorber, a moving mechanism, and a controller. The droplet ejection head includes liquid passages having at their leading ends ejection openings which eject droplets, an ejection face which faces a recording medium onto which droplets ejected from the ejection openings are placed, and an actuator which applies energy to liquid inside the liquid passages. The absorber includes a liquid-absorbent facing portion which faces the ejection openings when the absorber faces the ejection face. The moving mechanism moves the droplet ejection head and the absorber relatively to each other such that the droplet ejection head and the absorber are positioned in an absorbing position where the ejection openings and the facing portion face each other. The controller controls the moving mechanism to position the droplet ejection head and the absorber in the absorbing position, and while the droplet ejection head and the absorber are positioned in the absorbing position, controls the actuator to apply to the liquid in the liquid passages energy falling short for droplet ejection from each of the ejection openings thereby having a meniscus formed on each of the ejection openings contact the facing portion.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

The following describes a preferable embodiment of the present invention, with reference to the drawings.

Figure 1:
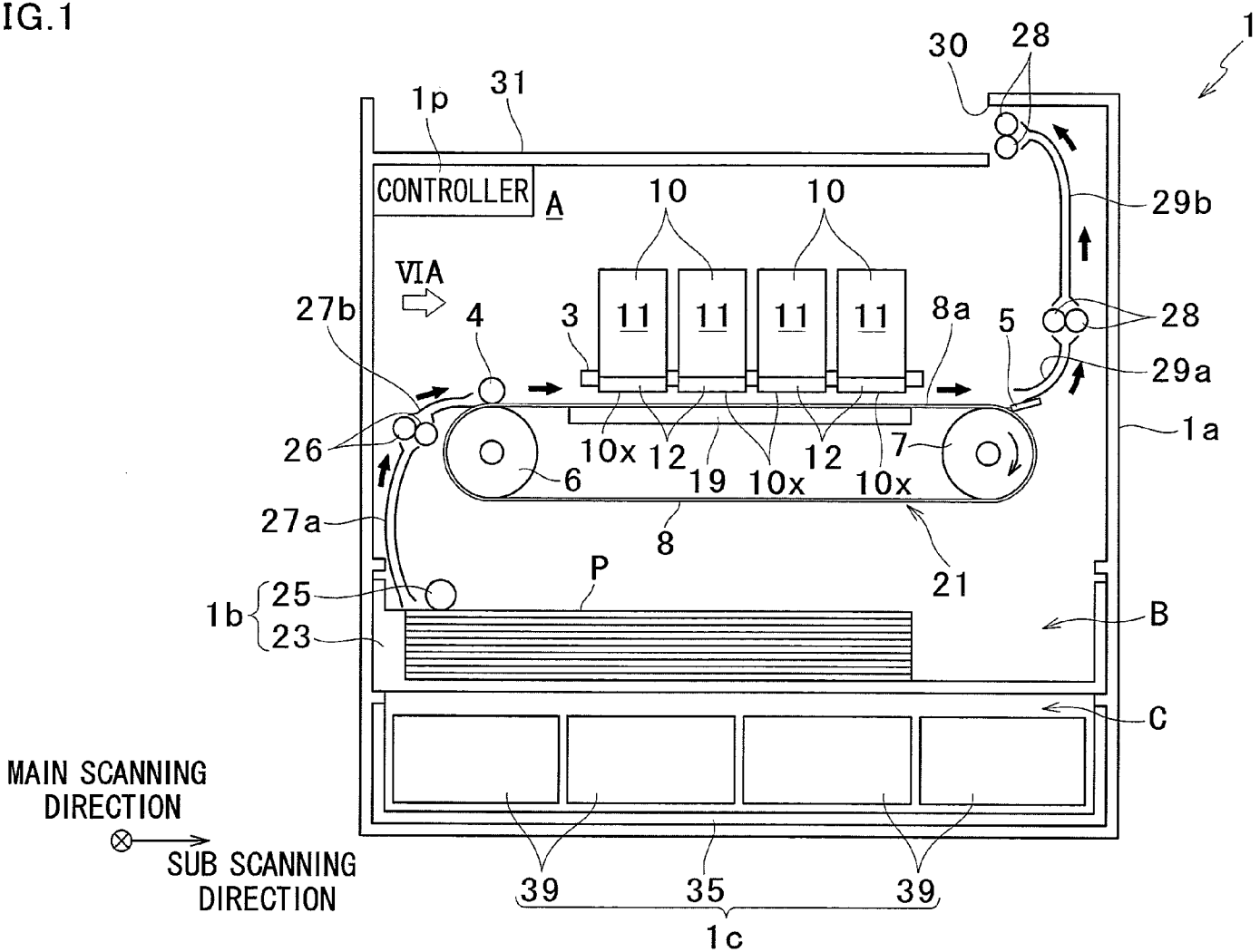
FIG. 1 is a schematic side view showing the inside of an inkjet printer, as a liquid droplet ejecting apparatus of a first embodiment, according to the present invention.

First, with reference to FIG. 1, the following describes the overall structure of a line inkjet printer 1, as a liquid droplet ejecting apparatus of a first embodiment, according to the present invention.

The printer 1 includes a casing 1*a* having a rectangular parallelepiped shape. On top of the casing 1*a* is provided a sheet output unit 31. The inside space of the casing 1*a* is divided into spaces A, B, and C sequentially from the top. The spaces A and B are spaces having therein a sheet conveyance path connected to a sheet output unit 31. In the space A, a sheet P is conveyed and an image is formed (i.e. recorded) on the sheet P. In the space B is performed an operation related to sheet feeding. The space C accommodates ink cartridges 39 serving as an ink supply source.

In the space A are disposed four inkjet heads 10, a conveyance unit 21 which conveys a sheet P, a maintenance unit 60 (see FIG. 6A and FIG. 6B), and a guide unit which guides the sheet P, and the like. On top of the space A is a controller 1*p*. The controller 1*p* controls operations of various parts of the printer 1, and administrates the entire operation of the printer 1.

The controller 1*p* controls operations of various parts of the printer 1 to perform recording on a sheet P, based on image data supplied from an external apparatus (a personal computer or the like connected to printer 1). When recording, the controller 1*p* controls preparations related to the recording, operations related to supplying, conveying, and outputting the sheet P, ejection of ink droplets in sync with the conveyance, and recovery and maintenance operation of the ejection characteristic, or the like.

The controller 1*p* includes: a CPU (Central Processing Unit) serving as a computation device, a ROM (Read Only Memory), a RAM (Random Access Memory: encompassing a non-volatile RAM); an ASIC (Application Specific Integrated Circuit), an I/F (Interface), an I/O (Input/Output Port), or the like. The ROM stores programs to be run by the CPU, and various fixed data. The RAM temporarily stores data (e.g. image data) needed for running a program. The ASIC performs signal processing or image processing, such as rewriting of image data, alignment, or the like. The I/F performs data communication with the external apparatus. The I/O performs input/output of detection signals from/to various sensors. These hardware structures in cooperation with the programs in the ROM structures the functional parts of the controller 1*p*.

The heads 10 are each a line head having substantially a rectangular parallelepiped shape which is long in a main scanning direction. The four heads 10 are aligned in a sub scanning direction at a predetermined pitch, and are supported by the casing 1*a* via a frame 3. Each of the heads 10 includes: a passage unit 12, eight actuator units 17 (see FIG. 2), and a reservoir unit 11. When recording, the four heads 10 eject from their under surfaces (ejection faces) 10*x*, ink droplets of Magenta, Cyan, Yellow, and Black, respectively. The structure of each head 10 is later detailed.

The maintenance unit 60 includes an absorber 50, a moving mechanism which moves the absorber 50, and a not-shown elevation mechanism which moves the frame 3 in the vertical direction. The absorber 50 and the moving mechanism are provided to each of the heads 10. The structure of the maintenance unit 60 is later detailed.

As shown in FIG. 1, the conveyance unit 21 includes: belt rollers 6 and 7, an endless conveyor belt 8 looped around the rollers 6 and 7, a nip roller 4 and a separation plate 5 disposed outside the conveyor belt 8, a platen 19 having a rectangular parallelepiped shape, which is disposed inside the conveyor belt 8, or the like.

The belt roller 7 is a drive roller which is driven by a not-shown conveyance motor to rotate clockwise in FIG. 1. With the rotation of the belt roller 7, the conveyor belt 8 runs in a direction shown by the bold arrow in FIG. 1. The belt roller 6 is a driven roller and is rotated clockwise in FIG. 1 by the motion of the conveyor belt 8. The nip roller 4 is disposed to face the belt roller 6 and presses a sheet P supplied via a later-described upstream guide unit against the outer circumference 8*a* of the conveyor belt 8.

The outer circumference 8*a* has a silicon layer having a low adhesiveness. The separation plate 5 is disposed to face the belt roller 7, and separates the sheet P from the outer circumference 8*a*, and guides the sheet P to a later-described downstream guide unit. The platen 19 is disposed to face the four heads 10, and support the upper part of the loop formed by the conveyor belt 8. This forms a suitable gap for recording, between the sheet P disposed on the outer circumference 8*a* and the ejection faces 10*x*.

The guide unit includes the upstream guide unit and the downstream guide unit disposed to sandwich the conveyance unit 21. The upstream guide unit has two guides 27*a* and 27*b* and a pair of feed rollers 26. This guide unit connects a later-described sheet-feeder unit 1*b* to the conveyance unit 21. The downstream guide unit has two guides 29*a* and 29*b* and two pairs of feed rollers 28. This guide unit connects the conveyance unit 21 to the sheet output unit 31.

In the space B is disposed a sheet-feeder unit 1*b*. The sheet-feeder unit 1*b* has a sheet-feeding tray 23 and a sheet-feeding roller 25. The sheet-feeding tray 23 is detachable from the casing 1*a*. The sheet-feeding tray 23 is a box whose top is opened, and is capable of accommodating sheets P of various sizes. The sheet-feeding roller 25 sends out and supplies to the upstream guide unit, the uppermost one of the sheets P in the sheet-feeding tray 23.

In the space C is disposed an ink unit 1*c*. The ink unit 1*c* has a cartridge tray 35 and four cartridges 39 accommodated and aligned in the tray 35. The tray 35 is detachable from the casing 1*a*, with the cartridges 39 accommodated therein. When the tray 35 is attached to the casing 1*a*, the cartridges 39 are aligned in the sub scanning direction. The ink in the cartridges 39 is supplied to the corresponding heads 10 via not-shown tubes, respectively.

Figure 4:
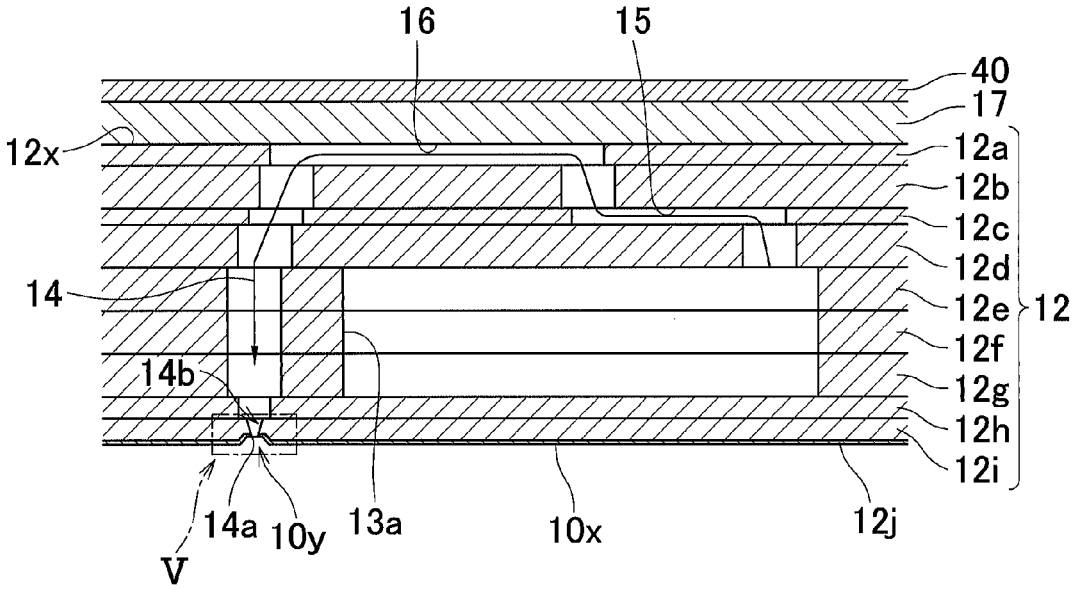
FIG. 4 is a partial cross sectional view taken along the line IV-IV of FIG. 3.

As described, the sheet conveyance path extending from the sheet-feeder unit 1*b* to the sheet output unit 31 via the conveyance unit 21 is formed in the spaces A and B. The sheet P sent out from the sheet-feeding tray 23 passes immediately underneath the heads 10 in the sub scanning direction. At this time, the sheet P successively faces the ejection faces 10*x* and a color image is formed on the sheet P by placing the ink droplets ejected from the ejection openings 14*a* (FIG. 4). After that, the sheet P is separated by the separation plate 5, conveyed upward, and output from the opening 30 to the sheet output unit 31.

The sub scanning direction is a direction parallel to the horizontal plane and parallel to the conveyance direction of the sheet P conveyed by the conveyance unit 21. The main scanning direction is a direction parallel to the horizontal plane, and perpendicularly crossing the sub scanning direction.

Next, with reference to FIG. 2 to FIG. 5, the following details the heads 10.

Each of the heads 10 includes a passage unit 12, actuator units 17, flexible print circuits (FPC) 40, a reservoir unit 11, and a not-shown control substrate, or the like. The passage unit 12 and the reservoir unit 11 are stacked in this order and structure a layered member. Each of the FPCs 40 is a flat flexible substrate, and is provided to each of the actuator units 17. Note that FIG. 2 only shows FPCs 40 for two of the actuator units 17. Further in FIG. 2, the two actuator units 17 below the FPC 40, which should be illustrated in dotted lines, are shown by solid lines as are the cases of the other actuator units 17. The FPC 40 has a driver IC mounted thereon, and electrically connects the actuator unit 17 to the control substrate. Inside the layered member structured by the passage unit 12 and the reservoir unit 11, there are formed ink passages each of which guides the ink supplied from the cartridge 39 to the ejection opening 14*a*. Each ink passage includes an upstream passage formed inside the reservoir unit 11 and a downstream passage formed inside the passage unit 12, and has ejection opening 14*a* at its leading end.

The control substrate generates a control signal, based on image data supplied from an external apparatus. The driver IC generates a drive signal based on the control signal.

Figure 2:
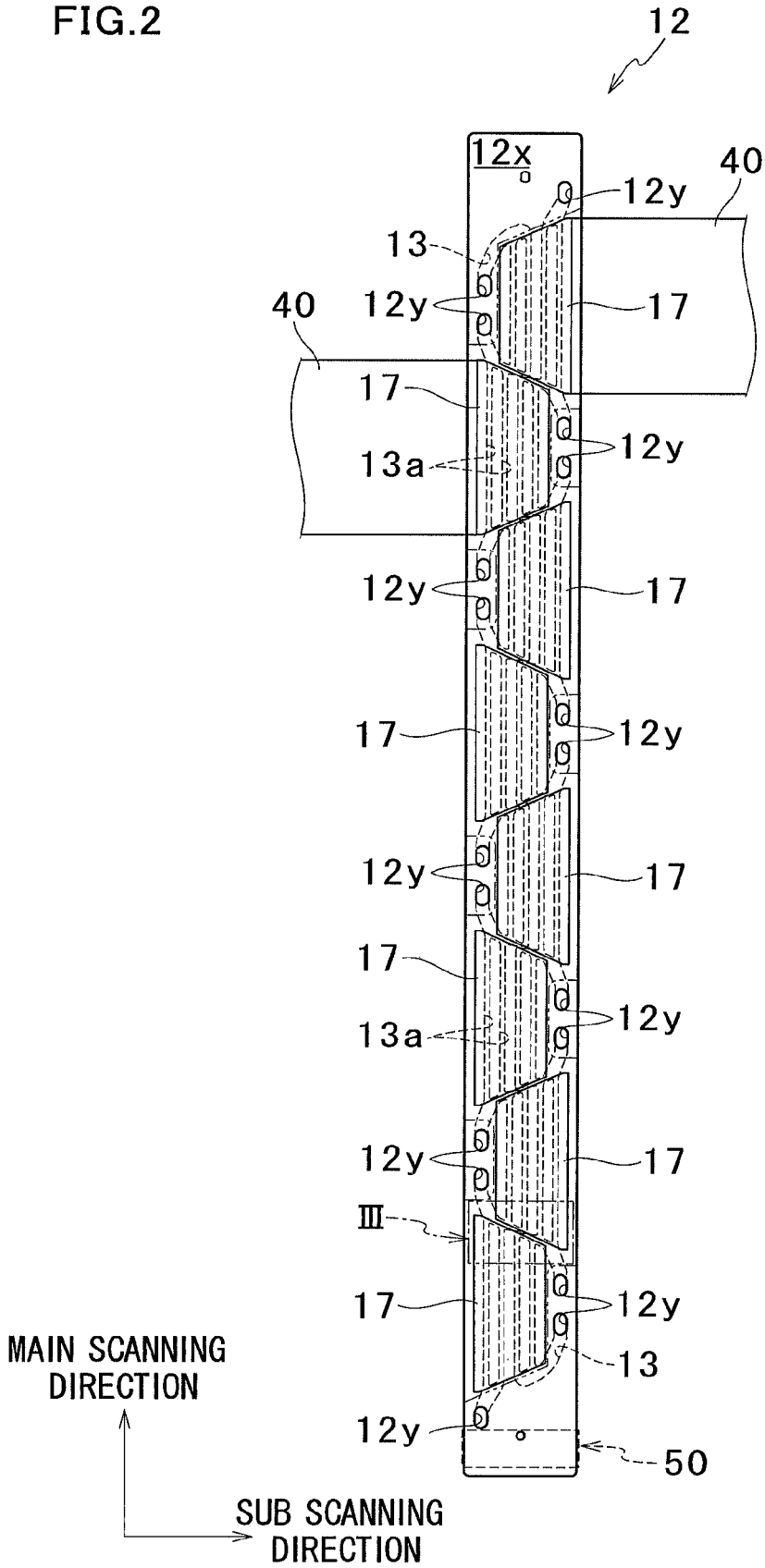
FIG. 2 is a plan view showing a passage unit included in an inkjet head of the printer shown in FIG. 1.
Figure 3:
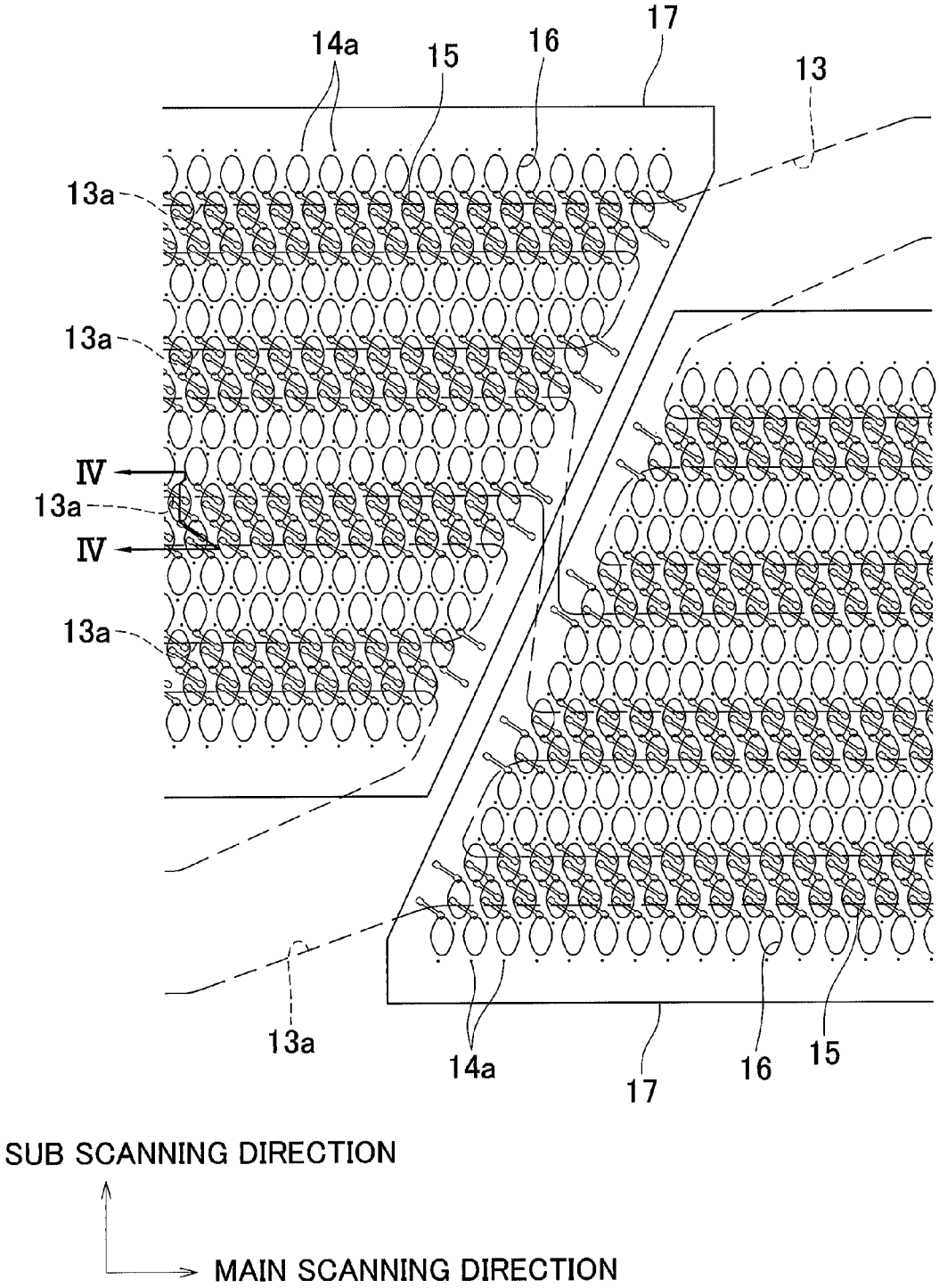
FIG. 3 is an enlarged view showing the Area III of FIG. 2, which is surrounded by a dashed line.

The reservoir unit 11 is structured by a resin member and a plurality of metal plates. Inside the reservoir unit 11 is formed the upstream passage including a reservoir for temporarily storing ink. The upstream passage has one end which communicates with a tube connected to a cartridge 39 and another end which communicates with an opening 12*y* formed on top face 12*x*. The under surface of the reservoir unit 11 is adhered to an area of the top face 12*x* where the actuator unit 17 is not disposed. As shown in FIG. 2, the adhesion area is an area including the opening 12*y* which is surrounded by a double-dashed line. The under surface of the reservoir unit 11 has protrusion and recess. The protrusion is adhered to the top face 12*x*, and the recess faces the actuator unit 17 with a slight gap therebetween.

As shown in FIG. 4, the passage unit 12 is structured by nine metal plates 12*a* to 12*i*. On the top face 12*x*, an opening 12*y* which communicates with the upstream passage and an opening of the pressure chamber 16 are formed. Inside the passage unit 12 is a downstream passage extending from the opening 12*y* to the ejection opening 14*a*. The downstream passage is structured by: a manifold channel 13 whose one end is an opening 12*y*, a sub manifold channel 13*a* branched from another end of the manifold channel 13, and a plurality of individual ink passages 14 each extending from an outlet of the sub manifold channel 13*a* to an ejection opening 14*a* via a pressure chamber 16. As shown in FIG. 4, between the sub manifold channel 13*a* and the pressure chamber 16 is disposed an aperture 15 for adjusting the passage resistance.

On the plate 12*i* are formed a plurality of through holes 14*b* each having a reversed truncated cone shape. Each of the through holes 14*b* structures a leading end of the individual ink passage 14. The under surface of the plate 12*i* has a recess 12*i*1 for each of the through holes 14*b*. The entire under surface of the plate 12*i* except for the through holes 14*b* is coated by a water-repellent film 12*j* having a certain thickness. In other words, the recess 12*i*1 is also coated by the water-repellent film 12*j*. The under surface of the water-repellent film 12*j* (the surface opposite to the plate 12*i*) is an ejection face 10*x*, and the opening on the water-repellent film 12*j* serves as the ejection opening 14*a*. The recess 12*i*1 covered by the water-repellent film 12*j* is recess 10*y*. The depth of the recess 10*y* equals to that of the recess 12*i*1. The ejection opening 14*a* is positioned at the center of the recess 10*y*.

The actuator units 17 have a planer trapezoidal shape, and are disposed in two columns in a zigzag manner on the top face 12*x*. Each actuator unit 17 includes a plurality of piezoelectric layers which are stacked in the thickness direction, and electrodes formed on the top faces of the first and second piezoelectric layers from the top. On the top face of the uppermost piezoelectric layer are formed a plurality of individual electrodes. Each of the individual electrodes faces the pressure chamber 16. On the entire top face of the second piezoelectric layer from the top, a common electrode is formed. Each electrode is electrically connected to a terminal of the FPC 50. To the individual electrodes, drive signals generated by the driver IC are selectively supplied. The common electrode is held at a constant potential. In the present embodiment, only the uppermost piezoelectric layer has a plurality of active portions (portions sandwiched by electrodes in the thickness direction). The other piezoelectric layers do not have active portions, and functions as a diaphragm. Each active portion is independently displaceable, and displaces in at least one vibration mode selected from d31, d33, and d15 (d31 in the present embodiment). As is understood from the above, the actuator unit 17 has a plurality of actuators corresponding to the pressure chambers 16 respectively, each actuator being a layered member having a single active portion and at least one non-active portion. Driving each actuator applies a pressure to ink inside the corresponding pressure chamber 16. The under surface of the actuator unit 17 (that is, the under surface of the lowermost piezoelectric layer) seals the opening of the pressure chamber 16.

Figure 6B:
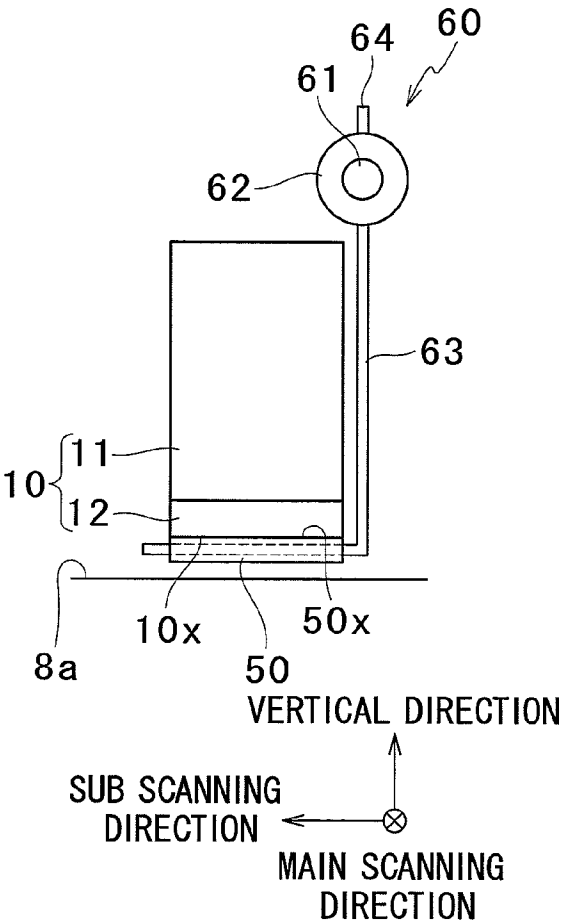
FIG. 6B is a side view viewed in the VIB direction indicated by an outlined-arrow in FIG. 6A.
Figure 6A:
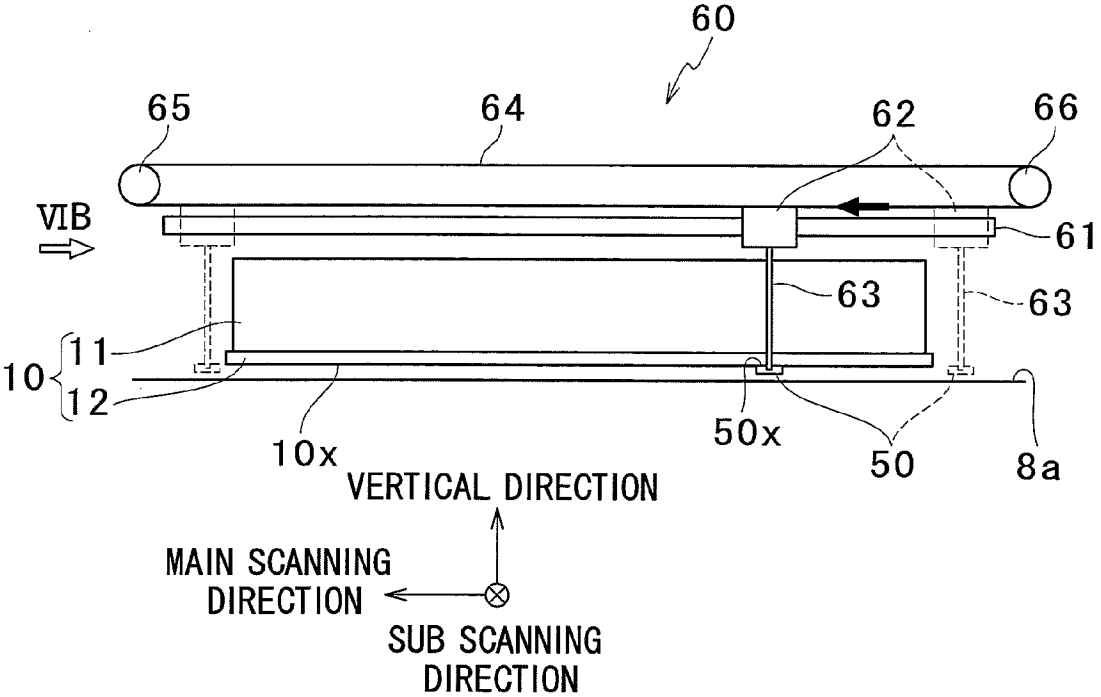
FIG. 6A is a side view of one head and an absorber provided to the head, which are viewed in the VIA direction indicated by an outlined-arrow in FIG. 1.

Next, with reference to FIG. 6A and FIG. 6B, the following details the maintenance unit 60.

As shown in FIG. 6A, the moving mechanism includes rollers 65 and 66, an endless belt 64 looped around the rollers 65 and 66, a slider 62 fixed to the belt 64, a bar 61 supporting the slider 62 in such a manner that the slider 62 is able to slide, and a support portion 63 fixed to the slider 62.

The roller 65 is a drive roller which is driven by a not-shown motor to rotate both clockwise and counter clockwise in FIG. 6A. The roller 66 is a driven roller. When the roller 65 rotates clockwise in FIG. 6A, the belt 64 runs in a direction indicated by the bold arrow, and the roller 66 rotates clockwise with the motion of the belt 64.

The slider 62 is cylindrical and has a bar 61 penetrating its hollow part. The slider 62 is movable while contacting the outer circumference of the bar 61. The slider 62 is fixed to the lower part of the loop formed by the belt 64. The slider 62 is reciprocable between one end and the other end of the bar 61, with the motion of the belt 64. The bar 61 is a cylindrical member made of metal for example. As shown in FIG. 6B, the bar 61 is fixed to the casing 1*a* and extends in the main scanning direction in a position obliquely above from the head 10. The bar 61 is longer than the head 10 in the main scanning direction, and projects from the both ends of the head 10 in the main scanning direction. The support portion 63 is an L-shaped stick, which is fixed to the outer circumference of the slider 62. The support portion 63 has a vertical portion extended in the vertical direction, and a horizontal portion extended in the sub scanning direction. The vertical portion is disposed along a side surface of the head 10 and is spaced from the side surface. The horizontal portion is dispose below the ejection face 10*x*. The leading end of the horizontal portion is positioned outwardly from another side surface of the head 10. The horizontal portion penetrates and supports the absorber 50.

The absorber 50 is made of an ink-absorbent sponge or the like. The absorber 50 is a rectangular sheet which is long in the sub scanning direction and shorter than the ejection face 10*x* in the main scanning direction. The length of the absorber 50 in the sub scanning direction is the same as that of the ejection face 10*x*. The absorber 50 is capable of reciprocating in the main scanning direction, along with the slider 62. That is, as the slider 62 moves from one end to the other end of the bar 61, the absorber 50 moves from the one end to the other end of the ejection face 10*x*. This way, the absorber 50 is able to face all the ejection openings 14*a* formed on the ejection face 10*x*.

The elevation mechanism moves the frame 3 upward and downward, such that the four heads 10 supported by the frame 3 are moved to a recording position, an absorbing position, or a standby position. The recording position is a position for recording. The absorbing position is a position for meniscus absorption. The standby position is a position for capping (an operation of covering the ejection face 10*x* with a not-shown cap). The vertical distance between the ejection face 10*x* and the outer circumference 8*a* is increased sequentially, when the head 10 is in the recording position, in the absorbing position, and in the standby position. The meniscus absorption means to absorb, with the absorber 50, a part of a meniscus 14*m* (particularly the leading end) projecting from an ejection opening 14*a* while the meniscus 14*m* formed on the ejection opening 14*a* is vibrated without ejection of an ink droplet therefrom (see FIG. 8). When the head 10 is in the absorbing position, the absorber 50 faces the ejection face 10*x* and moves while contacting the ejection face 10*x*. When the head 10 is in the recording position, the absorber 50 is disposed in one of two standby positions (one end and the other end of the range within which the absorber 50 reciprocates) shown by the dotted lines in FIG. 6A. When the head 10 is in the standby position, the absorber 50 is apart from the head 10 relative to the main scanning direction, and does not interfere the upward and downward movement of the head 10.

Figure 7:
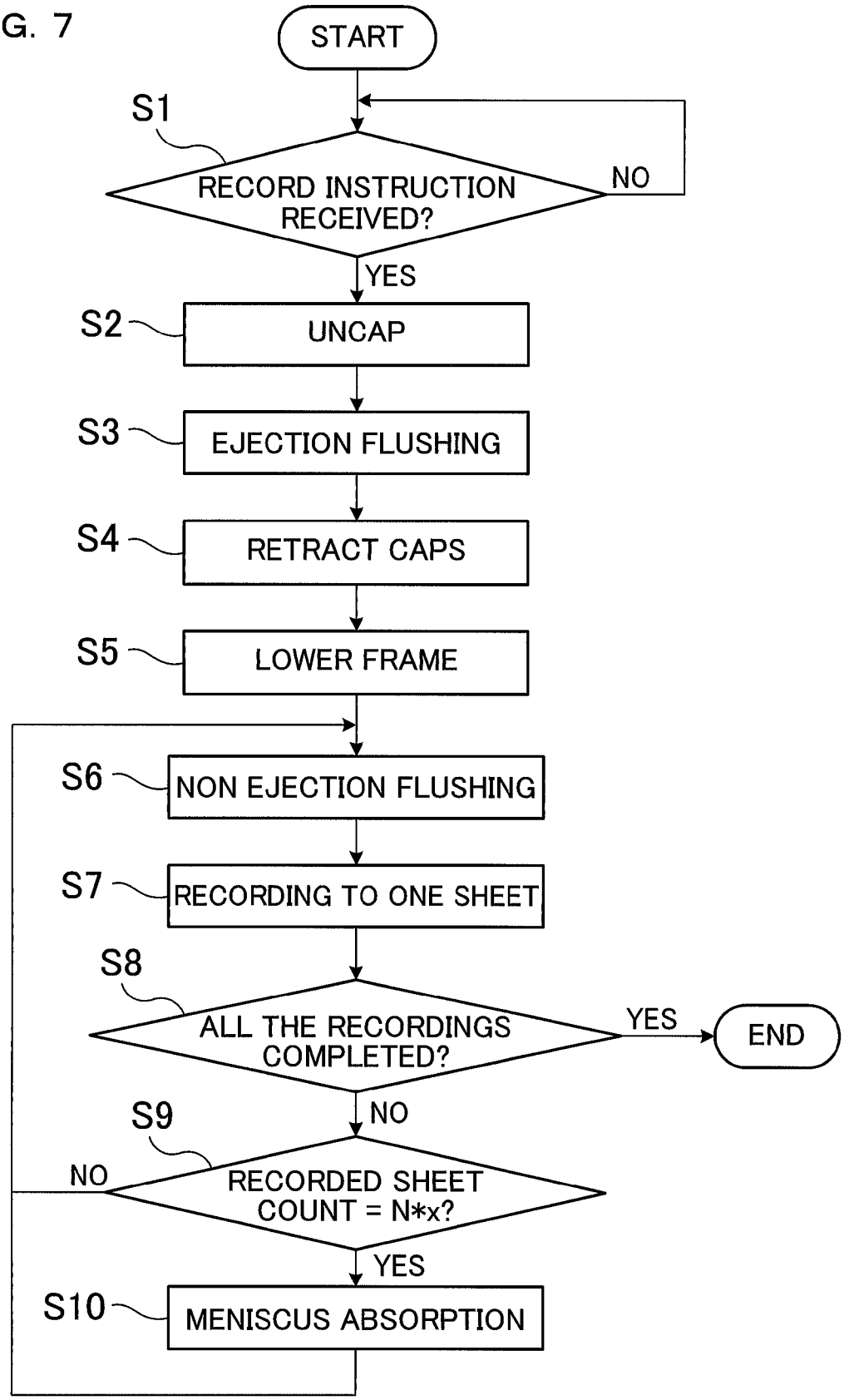
FIG. 7 is a flowchart of a record-related control in the printer of FIG. 1.

Next, with reference to FIG. 7, the following describes control related to recording operation performed in the printer 1. The below described operation is controlled by the controller 1*p* so as to be performed substantially at the same time in the four heads 10.

Capping is performed when the printer 1 is powered off, or when the printer 1 receives no record instructions for a predetermined period, or the like. This restrains thickening and solidification of ink nearby an ejection opening 14*a* of each head 10. At this time, the four heads 10 are in the standby position which is above the position shown in FIG. 1, FIG. 6A, and FIG. 6B, and the cap is disposed between the outer circumference 8*a* and each ejection face 10*x*. When the printer 1 is powered on, the controller 1*p* performs the following operation.

First, the controller 1*p* determines whether or not a record instruction is received from an external apparatus (S1). If no record instructions is received (S1: NO), the controller 1*p* repeats the same step.

When a record instruction is received (S1: YES), the controller 1*p* drives the cap moving mechanism to slightly lower the cap and to separate the cap from the ejection face 10*x* (S2: uncapping). The controller 1*p* then controls the actuator units 17 to perform ejection flushing (S3), while maintaining the uncapped state. Specifically, in S3, the controller 1*p* controls each actuator unit 17 to apply to the ink inside the pressure chamber 16 energy sufficient for ejecting an ink droplet from the ejection opening 14*a*. This way, a predetermined number of ink droplets are ejected from all the ejection openings 14*a*.

After S3, the controller 1*p* drives the cap moving mechanism to move the cap in the main scanning direction to a position where the cap does not face the ejection face 10*x* in the vertical direction (S4). The controller 1*p* then controls the elevation mechanism to lower the frame 3, and thereby moves the four heads 10 from the standby position to the recording position (S5). When each head 10 is in the recording position, the outer circumference 8*a* and the ejection face 10*x* are apart from each other with a gap therebetween which is suitable for recording, as shown in FIG. 1, FIG. 6A, and FIG. 6B.

After S5, the controller 1*p* controls the actuator unit 17 to perform the non-ejection flushing (S6). Specifically, in S6, the controller 1*p* controls the actuator unit 17 to apply to the ink inside the pressure chamber 16 energy falling short for ink droplet ejection from the ejection opening 14*a*. This way, the meniscus 14*m* at each ejection opening 14*a* is vibrated.

After S6, the controller 1*p* performs record control to the first sheet P (S7). That is, the controller 1*p* controls driving of a paper-feeding motor, the conveyance motor, a feed roller, the actuator unit 17, or the like to perform a series of recording-related operations including paper feeding, conveying, recording, and outputting. At this time, the sheet P is fed from the sheet-feeding tray 23 to the conveyance unit 21. When the sheet P passes under each ejection face 10*x*, an image based on image data is formed. The sheet P is output to the sheet output unit 31 thereafter. This series of operations related to recording are repeated a predetermined number of times instructed by the record instruction.

After S7, the controller 1*p* determines whether all the recordings instructed by the record instruction received in S1 are completed (S8).

If all the recordings are completed (S8: YES), the controller 1*p* ends the routine. At this time, the operations of paper feeding, conveying, recording and outputting are stopped. If no record instruction is received for a predetermined period, the controller 1P controls the elevation mechanism to elevate the frame 3, and moves the head 10 from the recording position to the standby position. After the moving of the head 10 is completed, the controller 1P controls the cap moving mechanism to perform capping for each ejection face 14*a*. When all the recordings are not yet completed (S8: NO), the controller 1*p* determines, based on the record instruction, whether or not number of sheets P having been subjected to recording (recorded sheet count) is N*x (where x is a natural number) (S9).

If the recorded sheet count is not N*x (S9: NO), the controller 1*p* returns to S6 without meniscus absorption (S10). When the recorded sheet count is N*x (S9: YES), the controller 1*p* performs meniscus absorption (S10).

In S10, the controller 1*p* controls the elevation mechanism to elevate the frame 3, and thereby moves the heads 10 from the recording position to the absorbing position. After the moving of the head 10 is completed, the controller 1P controls the moving mechanism to move the slider 62. At this time, the absorber 50 moves in the main scanning direction from the one standby position (e.g. right side of FIG. 6A) to the other standby position (e.g. left side of FIG. 6A), with the movement of the slider 62. During this movement, the absorber 50 contacts the ejection face 10*x*.

Figure 8:
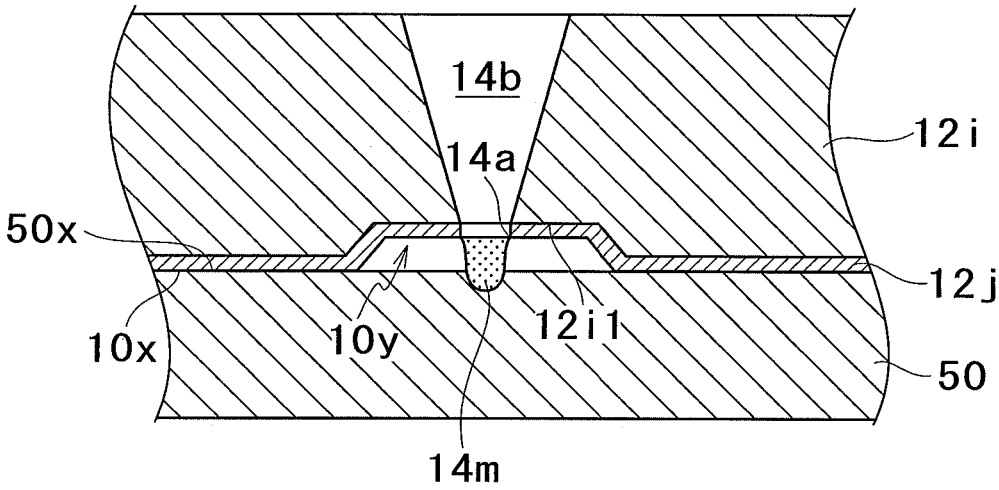
FIG. 8 is a partially enlarged cross sectional view corresponding to FIG. 5, which shows a meniscus being absorbed.

In S10, the controller 1*p* moves the absorber 50 at a constant speed. As shown in FIG. 8, when the absorber 50 is in a position where the absorber 50 faces the ejection opening 14*a*, the controller 1*p* controls the actuator unit 17 to apply to the ink inside the pressure chamber 16 energy falling short for ejection of an ink droplet from the ejection opening 14*a*. This way, the meniscus 14*m* formed on the ejection opening 14*a* projects from the ejection opening 14*a* by an amount which surpasses the depth of the recess 10*y*, thus contacting the top face 50*x* of the absorber 50. At this time, the part of the meniscus 14*m* projecting from the ejection opening 14*a* (particularly the leading end of the meniscus 14*m*) is absorbed by the absorber 50. For each ejection opening 14*a*, vibration of meniscus 14*m* (i.e., an operation for causing the meniscus to project from the ejection opening 14*a*) is repeated a plurality of number of times. This way, the ink forming the meniscus 14*m* is absorbed by the absorber 50, and is discharged from the head 10.

For example, the control of the actuator unit 17 in S10 may be performed as follows. That is, all the actuator units 17 of the head 10 may be driven at the same time. Alternatively, the eight actuator units 17 of the head 10 may be driven at a different timings; e.g., sequentially from the actuator unit 17 closest to the one standby position, in sync with the movement of the absorber 50. Further, alternatively, a single actuator unit 17 may be divided into a plurality of blocks each having a width (the size in the main scanning direction) corresponding to the width of the absorber 50, and the actuator unit 17 may be driven on the block-by-block basis.

When the absorber 50 reaches the other standby position, the controller 1*p* controls the moving mechanism to stop the movement of the slider 62. The controller 1*p* then controls the elevation mechanism to lower the frame 3, and thereby moves the four heads 10 from the absorbing position to the recording position. The controller 1*p* then returns to S6. Note that the slider 62 and the absorber 50 stays in the other standby position until the subsequent meniscus absorption (S10). In the subsequent meniscus absorption (S10), the slider 62 and the absorber 50 move from the other standby position to the one standby position; i.e., in a direction opposite to the direction of moving in the previous meniscus absorption (S10).

The ink absorbed through the meniscus absorption (S10) by the absorber 50 may be removed from the absorber 50 by having the absorber 50 contact another absorber. This may take place before returning to S6, after performing S10 once or several times. This enables the absorber 50 to recover its ink absorbance.

As is described hereinabove, the printer 1 of the present embodiment performs, under control by the controller 1*p*, the meniscus absorption (S10: an operation of having the top face 50*x* face the ejection opening 14*a* and contact a meniscus 14*m*). This way, the thickened ink forming the meniscus 14*m* is absorbed by the absorber 50 and is discharged from the ink passage of the head 10. Since the thickened ink is discharged from the head 10 without a need of ejecting ink droplets, the number of times ejection flushing is performed is reduced. That is, with the present embodiment, the ink consumption volume related to recovering of the ejection performance is restrained.

During the meniscus absorption, the ejection opening 14*a* and the top face 50*x* faces each other with the gap formed by the recess 10*y* therebetween. If no gap is formed between the ejection opening 14*a* and the top face 50*x* during the meniscus absorption, a capillary phenomenon occurs and the absorber 50 excessively absorbs ink from the ejection opening 14*a*. In the present embodiment on the other hand, a gap is formed by the recess 10*y* between the ejection opening 14*a* and the top face 50*x*. Therefore, it is possible to reduce the problem of capillary phenomenon, and reliably restrain the ink consumption volume. Further, the presence of the gap formed by the recess 10*y* protects the periphery of the ejection opening 14*a* and the water-repellent film 12*j* formed the periphery (in the recess 12*i*1), and prevents adhesion of ink to the periphery of the ejection opening 14*a*. The effect of preventing ink adhesion is exerted particularly when the meniscus absorption is performed while moving the head 10 and the absorber 50 relatively to each other.

During the meniscus absorption, the top face 50*x* and the ejection face 10*x* contact each other, and the ejection opening 14*a* and the top face 50*x* face each other with the gap formed by the recess 10*y* therebetween. This enables simplification of the structure of the printer 1 and downsizing of the same, as compared with the case where the top face 50*x* and the ejection face 10*x* are apart from each other by a certain distance and not contacting each other.

The recess 10*y* formed on a part of the ejection face 10*x* including the ejection opening 14*a* forms the gap between the ejection opening 14*a* and the top face 50*x*. The controller 1*p*, when performing the meniscus absorption, controls the actuator unit 17 to cause the meniscus 14*m* formed on the ejection opening 14*a* to project from the ejection opening 14*a* by an amount greater than the depth of the recess 10*y*. The recess 10*y* and the control based on the recess 10*y* provide effective restraint of the ink consumption volume, effective prevention of ink adhesion to the ejection opening 14*a*, effective protection of the periphery of the ejection opening 14*a*, and the like.

As shown in FIG. 7, when more than N number of sheets P (where N is an integer of not less than 2; N=100 in the present embodiment) are to be continuously recorded, the controller 1*p* performs the meniscus absorption (S10) after completion of recording to the N-th sheet P (i.e., the 100th sheet P) and before performing recording to (N+1) th sheet P (i.e. the next sheet P). The controller 1*p* controls the moving mechanism to move the absorber 50. While the head 10 is disposed in the absorbing position, the controller 1*p* controls each actuator unit 17 to apply to the ink inside the pressure chamber 16 energy falling short for ejection of an ink droplet from the ejection opening 14*a*, and to cause the meniscus 14*m* formed on the ejection opening 14*a* to contact the top face 50*x*. This way, in the meniscus absorption, the leading end of the meniscus 14*m* is absorbed and the ejection performance is effectively recovered. Thus, the record quality is maintained. When ejection flushing is performed during continuous recording, ink droplets are ejected to the conveyor belt 8 and the sheet P, thus contaminating the conveyor belt 8 and the sheet P or causing the problem of consumption. These problems however are reduced with the present embodiment.

During the continuous recording, the controller 1*p* performs meniscus absorption (S10) every time recording to the N number of sheets (where N is an integer of not less than 2; N=100 in the present embodiment) are completed. This way, the record quality is reliably maintained.

The controller 1*p* controls the actuator unit 17 to apply to the ink inside the pressure chamber 16 energy sufficient for ejecting the ink droplet from the ejection opening 14*a* (S3: ejection flushing). This takes place before the recording (S7) is performed and after the printer 1 is powered on or after the printer 1 has been in the standby mode for a predetermined period. This way, the record quality is reliably maintained.

The top face 50*x* of the absorber 50 faces some of the ejection openings 14*a* formed on the head 10. The controller 1*p* controls each actuator unit 17 related to the meniscus absorption, while controlling the moving mechanism to cause the head 10 and the absorber 50 to move relatively to each other in the main scanning direction. This enables downsizing of the absorber 50.

Next, with reference to FIG. 9 to FIG. 12, the following describes an inkjet printer as a liquid droplet ejecting apparatus of a second embodiment, according to the present invention. The printer of the present embodiment has the same structure as that of the first embodiment, except for the structures of the absorber, a moving mechanism for moving the absorber, and the head. The elements that are identical to those described in the first embodiment are given the same reference numerals, and no further explanation for those elements are provided hereinbelow.

Figure 5:
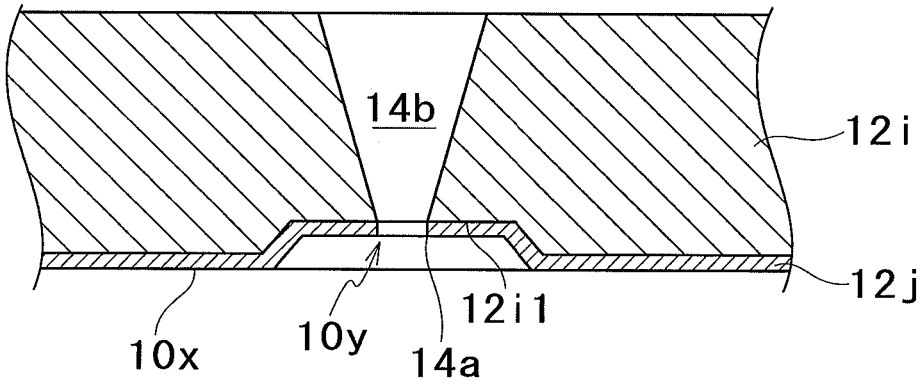
FIG. 5 is a partially enlarged cross sectional view of the Area V of FIG. 4, which is surrounded by a dashed line.
Figure 12:
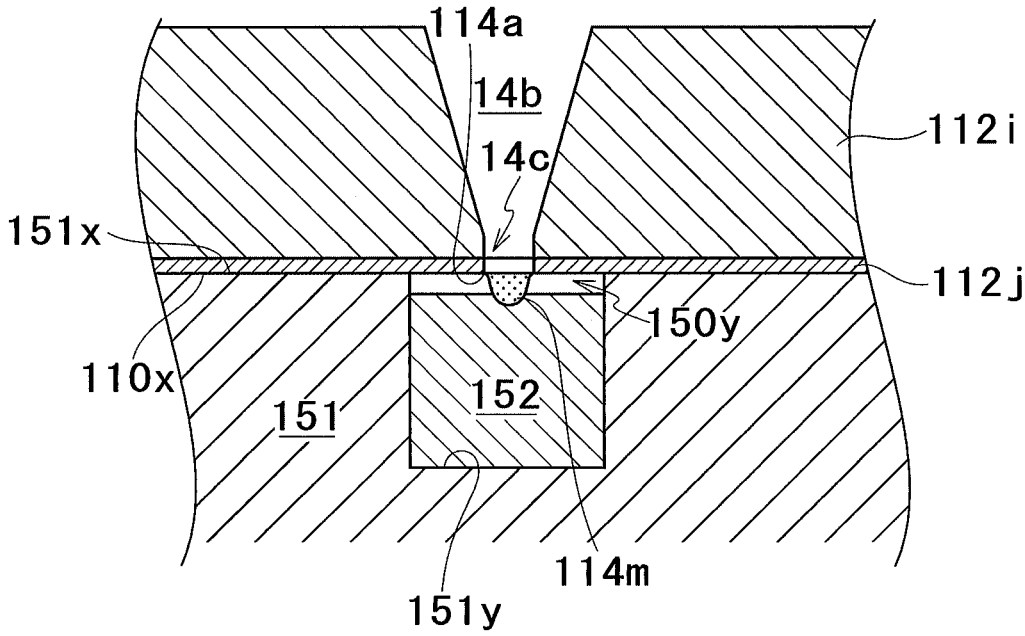
FIG. 12 is a partially enlarged cross sectional view, showing the Area XII of FIG. 10, which is surrounded by a dashed line, at the time of absorbing a meniscus.

As should be understood from FIG. 5 and FIG. 12, the head 110 of the present embodiment is different from the head 10 of the first embodiment in the shape of a through hole formed on a plate 112*i* which is a lowermost one of plates structuring the passage unit 112, and in that no recess 12*i*1 is formed on the under surface of the plate 112*i* (that is, no recess 10*y* is formed in the portion of the ejection face 110*x* including the ejection opening 114*a*). The through hole is formed on each ejection opening 114*a* and is a combination of a through hole 14*b* and the cylindrical through hole 14*c* connected at the bottom of the through hole 14*b* of the first embodiment. The entire under surface of the plate 112*i* (except for the through hole 14*c*) is covered by a water-repellent film 112*j* having a constant thickness. The water-repellent film 112*j* is formed horizontally along the under surface. The under surface (the surface opposite to the plate 112*i*) of the water-repellent film 112*j* serves as the ejection face 110*x*, and the opening on the water-repellent film 112*j* serves as the ejection opening 114*a*.

A maintenance unit 160 of the present embodiment has four absorbers 150 provided for the heads 110, respectively, and a moving mechanism which moves all the four absorbers 150 together, and an elevation mechanism. The elevation mechanism is the same as that of the first embodiment. The four absorbers 150 are movable in the main scanning direction and the vertical direction, by driving the moving mechanism.

Figure 10:
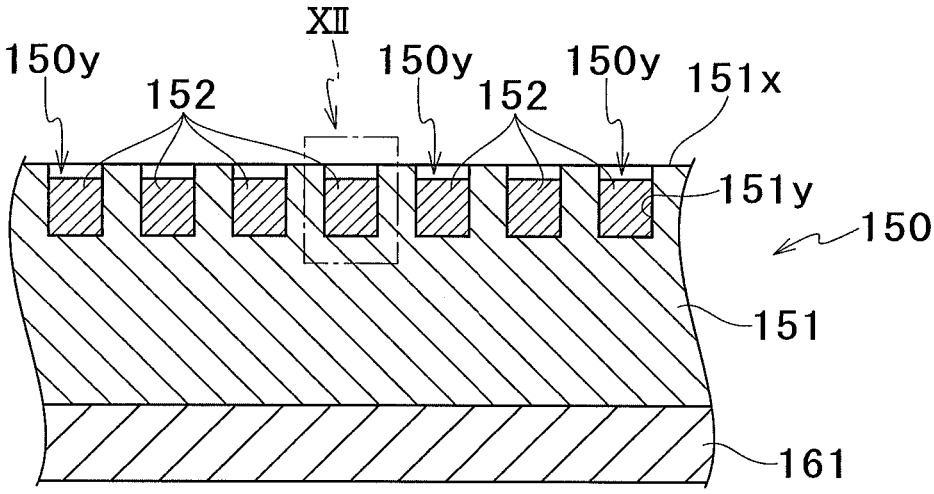
FIG. 10 is a partial cross sectional view taken along the line X-X of FIG. 9.

As shown in FIG. 10, each of the absorbers 150 has a supporter 151 made of a hard material such as resin, a plurality of absorbents 152 provided for ejection openings 114*a*, respectively.

Figure 9:
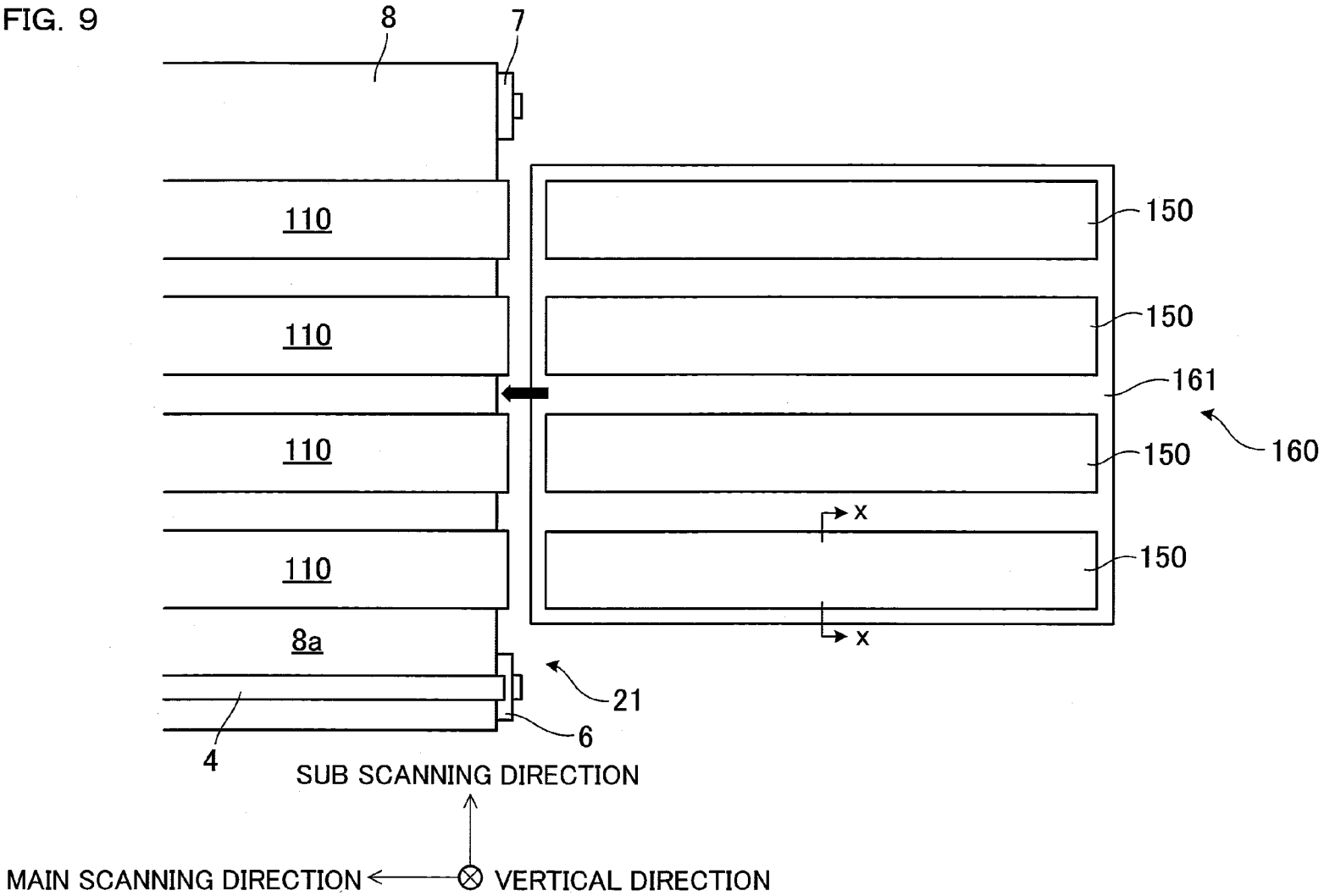
FIG. 9 is a partial plan view showing absorbers provided respectively to four heads of an inkjet printer as a liquid droplet ejecting apparatus of a second embodiment, according to the present invention.

The supporter 151 is a rectangular plate which is long in the main scanning direction, and defines the shape of the absorber 150 as shown in FIG. 9. The supporter 151 has the shape and size which are substantially the same as the ejection face 110*x*, in plan view. Although illustration is omitted in FIG. 9, blind holes 151*y* are disposed on the top face 151*x* of the supporter 151 in the same manner the ejection openings 114*a* are disposed, as shown in FIG. 10. Each blind hole 151*y* forms a cylindrical space having a greater diameter than the ejection opening 114*a*. When the meniscus absorption is performed and when the top face 151*x* and the ejection face 110*x* entirely face and contact each other, the respective center axes of each blind hole 151*y* and the corresponding ejection opening 114*a* coincide with each other (see FIG. 12).

The absorbent 152 is made of an ink-absorbent sponge or the like. The absorbent 152 is a cylindrical member having substantially the same diameter as that of the blind hole 151*y*, and is accommodated in the blind hole 151*y*. The height of the absorbent 152 is slightly smaller than the depth of the blind hole 151*y*, and the under surface of the absorbent 152 is in contact with the bottom of the blind hole 151*y*. Thus, a cylindrical recess 150*y* whose bottom is the top face of the absorbent 152 is formed in the upper portion of the blind hole 151*y*. The depth of the recess 150*y* corresponds the difference between the depth of the blind hole 151*y* and the height of the absorber 150.

As shown in FIG. 9, the four absorbers 150 are aligned in the sub scanning direction at the same pitch as the alignment of the heads 110, and are supported by the top face of the moving plate 161. The moving mechanism moves the moving plate 161 in the main scanning direction and the vertical direction.

The control performed in the printer of the present embodiment in relation to recording is the same as the first embodiment. That is, the controller 1*p* performs each step shown in FIG. 7.

When the meniscus absorption (S10) is not performed, the absorber 150 is still in the standby position shown in FIG. 9. In the standby position, each of the four absorbers 150 coincides with the corresponding head 110 relative to the sub scanning direction, and is apart from the corresponding head 110 in the main scanning direction. The top face 151*x* of each absorber 150 is positioned slightly lower than the corresponding ejection face 110*x* relative to the vertical direction.

Figure 11:
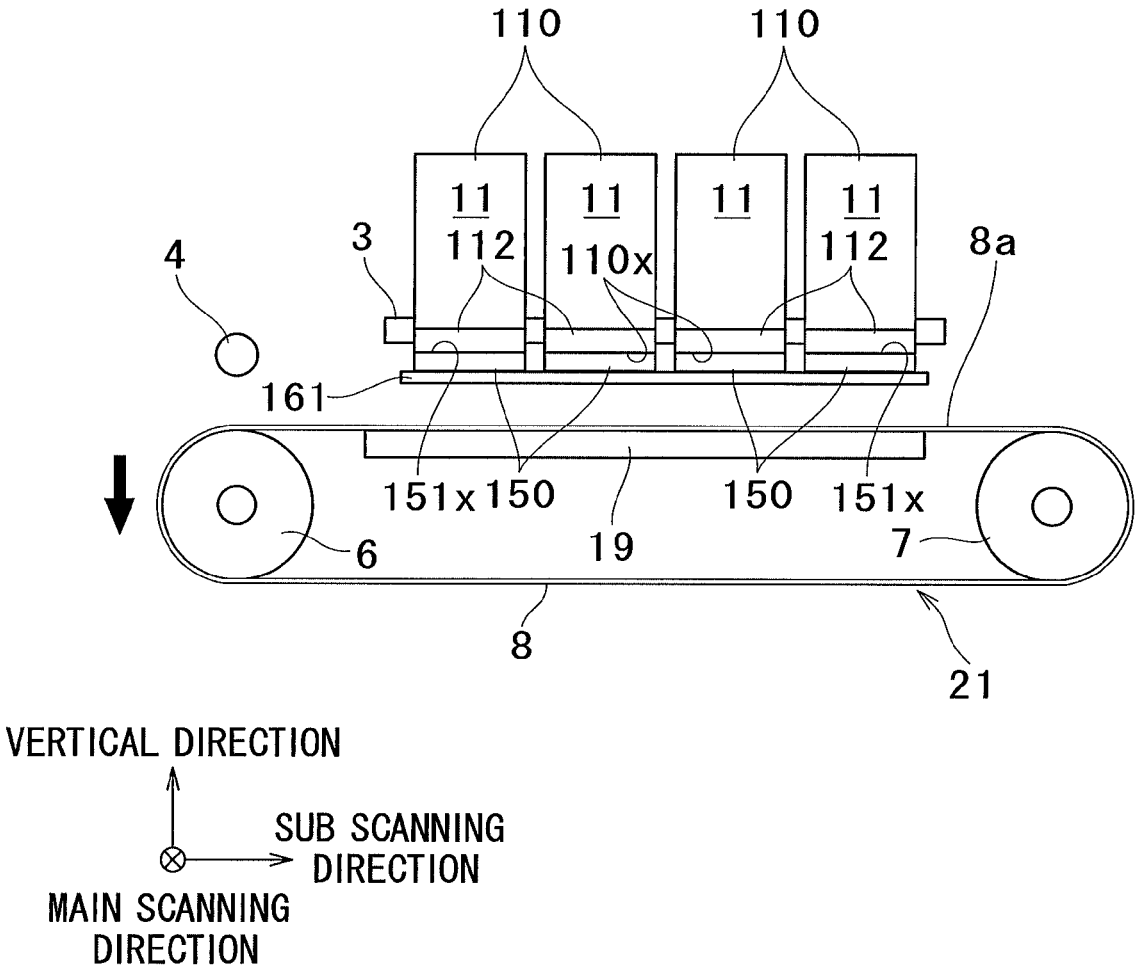
FIG. 11 is a side view corresponding to FIG. 1, which shows the absorbers of FIG. 9 being disposed in the respective absorbing positions.

In S10, the controller 1*p* first lowers the conveyance unit 21 in the direction indicated by the black arrow in FIG. 11. This forms a gap between the ejection face 110*x* and the outer circumference 8*a*, and the moving plate 161 or the like can be inserted therebetween. After that the controller 1*p* controls the moving mechanism to move the moving plate 161 in the main scanning direction to the underneath of the heads 110, as indicated by the black arrow in FIG. 9. The controller 1*p* controls the moving mechanism to stop the moving plate 161, when the top face 151*x* of the supporter 151 on each absorber 150 faces the ejection face 110*x* in the vertical direction, with a slight gap therebetween; i.e., when each absorber 150 coincides with the corresponding head 110 in plan view. After that, the controller 1*p* controls the moving mechanism to slightly elevate the moving plate 161. This way, the top face 151*x* and the ejection face 110*x* entirely contact each other. In S10, each absorber 150 moves from the standby position; i.e., a position where the recess 150*y* and the ejection opening 114*a* do not face each other (see FIG. 9), to the absorbing position. When the absorber 150 is in the absorbing position, all the ejection openings 114*a* face the corresponding recess 150*y*, respectively.

The controller 1*p* causes vibration of meniscus in each of the ejection openings 114*a* of all the heads 110, while maintaining the absorber 150 in the absorbing position. That is, for each of the ejection openings 114*a*, the controller 1*p* controls the actuator unit 17 to apply to the ink inside the pressure chamber 16 energy falling short for ejection of an ink droplet from the ejection opening 114*a*. Thus, as shown in FIG. 12, the meniscus 114*m* formed on the ejection opening 114*a* project from the ejection opening 114*a*, by an amount greater than the depth of the recess 150*y*, and contacts the surface of the absorbent 152 (the bottom face of the recess 150*y*). At this time a portion of the meniscus 114*m* projecting from the ejection opening 114*a* (particularly the leading end of the meniscus 114*m*) is absorbed by the absorbent 152. As in the first embodiment, for each ejection opening 114*a*, the vibration of the meniscus 114*m* (an operation for causing the meniscus 114*m* to project from the ejection opening 114*a*) is repeated a plurality of number of times. This way, the ink forming the meniscus 114*m* is absorbed by the absorbent 152 and discharged from the head 110.

After that, the controller 1*p* controls the moving mechanism to slightly lower the moving plate 161. Thus, the top face 151*x* and the ejection face 110*x* are separated from each other. Then, the controller 1*p* controls the moving mechanism to move the moving plate 161 in the main scanning direction, and bring back the absorber 150 to the standby position. Further, the controller 1*p* elevates the conveyance unit 21 to bring back the same to the recording position. The process then returns to S6.

For example, the ink absorbed through the meniscus absorption (S10) by the absorbent 152 may be discharged from the absorbent 152, through a path communicating the blind hole 151*y*. This enables the absorbent 152 to recover its ink absorbance.

As should be understood from the above, the printer of the present embodiment brings about the following effects, in addition to the effects of the printer 1 of the first embodiment.

Namely, as shown in FIG. 9, when the absorber 150 is in the absorbing position, the absorbent 152 faces all of the ejection openings 114*a* formed on the corresponding head 110. In S10, the controller 1*p* controls the actuator unit 17 in relation to the meniscus absorption, while controlling the moving mechanism to cause the head 110 and the absorber 150 to stop relatively to each other with the absorbents 152 facing all the ejection openings 114*a*, respectively. This way, the meniscus absorption is performed for all the ejection openings 114*a* formed on the head 110, at the same time. Therefore, control of the actuator unit 17 in relation to meniscus absorption is simple.

In meniscus absorption, if the head 110 and the absorber 150 are moved relatively to each other while the top face 151*x* and the ejection face 110*x* are contacting each other, the ejection face 110*x* and/or the top face 151*x* may be damaged due to the friction between the top face 151*x* and the ejection face 110*x*. Further, if no recess 150*y* is formed on the top face 151*x*; i.e., the top face of the absorbent 152 and the top face 151*x* are at the same level, the ink held on the absorbent 152 may adhere to the ejection face 110*x*. Such problems are reduced by stopping the movement of the head 110 and the absorber 150 relatively to each other, during the meniscus absorption, as is done in the present embodiment.

Note that the recess may be formed on one or both of the absorber and a part of the ejection face including the ejection openings. The shape of the recess is not limited to the truncated cone shape of the recess 10*y* in the first embodiment or to the cylindrical shape of the recess 150*y* in the second embodiment. Various shapes are possible. Further, the recess does not necessarily have to be provided for each ejection opening, and may be provided for every two or more ejection openings.

In the above embodiment, the recess 10*y*; 150*y* forms the gap between the ejection opening and the facing portion in the absorbing position. However, the present invention is not limited to this. For example, the recess 10*y*; 150*y* may be omitted, and the facing portion of the absorber and the ejection face may be disposed apart from each other with a certain distance therebetween so as to form the gap.

The absorber does not have to have the contact face which contacts the ejection face in the absorbing position. When the contact face is omitted from the absorber, for example, the meniscus absorption may be performed while keeping the facing portion of the absorber apart from the ejection face by a certain distance.

The present invention is not limited to a case where the ejection openings and the facing portion face each other in the absorbing position, with a gap therebetween. That is, the facing portion may contact the ejection openings in the absorbing position.

The structure of the absorber may be altered in various ways. The first embodiment deals with a case where the entire absorber 50 is ink absorbency; however, the only a portion nearby the top face 50*x* to face the ejection openings may have the ink-absorbency. For example, the absorber 50 of the first embodiment may be structured by a thin ink-absorbent sheet for structuring the top face 50*x* and another sheet which supports the ink-absorbent sheet. Further, the absorber 50 of the first embodiment may be formed in any given shape such as a cylindrical shape, instead of a sheet-like shape. For example, the absorber 50 may be formed in a cylindrical shape having a rotation shaft extending in the sub scanning direction. In meniscus absorption in this case, the absorber is rotated and moved in the main scanning direction, while having the circumferential surface of the absorber contact with the ejection face 10*x*. Such a cylindrical absorber includes a hard shaft and an ink-absorbent sheet provided on the circumferential surface of the shaft.

The moving mechanism is not particularly limited as long as the mechanism is capable of moving at least one of the head and the absorber. For example, in the above embodiments, the absorber is moved at the time of meniscus absorption; however, the head may be moved while keeping the absorber to a constant position. Alternatively, both of the absorber and the head may be moved.

In the first embodiment, the absorber 50 is moved at a constant speed at the time of meniscus absorption, however, the moving speed of the absorber 50 may be varied or the absorber 50 may be moved intermittently. The expression "moved intermittently" here means, for example, to move the absorber 50 to an absorbing position and then temporarily stop the absorber 50 to perform the meniscus absorption, and then move the absorber 50 to a next (adjacent) absorbing position and stop the absorber 50 to perform the meniscus absorption.

The absorber of the first embodiment may formed to have the same size as the size of the ejection face in plan view, and the absorber may be kept still relatively to the corresponding head during meniscus absorption, while having the entire absorber contact the ejection face, as is the case with the second embodiment.

The absorber of the second embodiment may be formed to have a smaller planer size than the ejection face, and the absorber may be moved relatively to the corresponding head at the time of the meniscus absorption, as is the case with the first embodiment. In this case, the absorber and the head may be moved relatively to each other at a constant speed, or moved intermittently.

In the second embodiment, the conveyance unit 21 is lowered at the time of meniscus absorption. This however is not necessary as long as the ejection face 110*x* at the time of recording and the outer circumference 8*a* are apart from each other with a gap into which the absorber 150 and the moving plate 161 are inserted.

In the second embodiment, when the absorber 150 moves at the time of meniscus absorption, the top face 151*x* may contact the ejection face 10*x*.

In the first embodiment, there are two standby positions of the absorber 50 (see dotted line of FIG. 6A), and the standby position is alternated between these two standby positions every time the meniscus absorption is performed. However, for example, it is possible to provide only one standby position of the absorber 50, and the absorber 50 may be brought back to the standby position every time the meniscus absorption is completed.

The above mentioned N number related to the continuous recording is not limited to 100, and may be any given integer of not less than 2.

The timing of performing the meniscus absorption may be any given timing and is not limited to: after completion of recording to the N-th recording medium and before performing recording to (N+1)th recording medium; or every time the recording to the N number of recording media are completed; or the like.

The non-ejection flushing may be performed, after recording is performed to every predetermined number of sheets, instead of performing every time a single sheet is recorded. Alternatively, the non-ejection flushing and the ejection flushing (S3) may be omitted. The present invention does not exclude a case of performing the ejection flushing during continuous recording. That is, a structure in which ejection flushing is performed during continuous recording is also encompassed in the scope of the present invention. Even in cases where ejection flushing is performed during continuous recording, the above mentioned meniscus absorption (S10) contributes to the reduction of the number of times the ejection flushing is performed, and restrains the liquid consumption volume related to recovery of the ejection performance.

The timing of the non-ejection flushing is not limited as long as the timing is before the start of recording. For example, the non-ejection flushing may be performed between the start of conveyance of a sheet and arrival of the sheet to the record area of the ejection face. This increases number of sheets recorded per unit time period.

The actuators may be controlled to perform the meniscus absorption for those ejection openings having performed no ejection after the previous meniscus absorption. This restrains unnecessary consumption of liquid, and further reduces the liquid consumption volume related to recovery of ejection performance.

The liquid absorbed by the facing portion of the absorber may be removed in various ways. For example, in the first embodiment, the support portion 63 may be structured as a member having a hollow portion. One end of the hollow portion may be opened to the horizontal portion, and the other end of the hollow portion to the top end of the vertical portion. To this structure, a pomp may be connected to the top end, via a tube, to suck in from the one end of the hollow portion the ink absorbed by the absorber 50. Alternatively, removal of the liquid absorbed by the facing portion of the absorber may be omitted.

In the first embodiment, the head is moved from the recording position to the absorbing position, at the time of meniscus absorption. The present invention however is not limited to such a structure. For example, by providing a gap into which gap the absorber can be inserted between the ejection face 10*x* and the outer circumference 8*a* at the time of recording, a single position is set as the both recording position and the absorbing position of the head, and there is no need of moving the head. This saves the time taken for moving the head, and therefore improves the throughput of the recording. In this case, the standby position of the absorber may be set to the part of the ejection face 10*x* having no ejection openings 14*a*; e.g., one end of the ejection face 10*x* in the longitudinal direction.

The recess 150*y* of the absorber 150 of the second embodiment may correspond to an area of the ejection face 110*x* in which the plurality of ejection openings 114*a* are distributed. The ejection openings 114*a* are disposed on the ejection face 110*x* in groups, each group being within a trapezoid area corresponding to one of eight actuator units 17. In view of this, the recess 150*y* may be formed in the shape and size to match the area having a group of ejection openings 114*a* in plan view.

The present invention is applicable to either a line type or a serial type liquid droplet ejecting apparatus. The liquid droplet ejecting apparatus of the present invention is not limited to a printer, and is applicable to facsimile machine, photocopier, or the like. The droplet ejection head of the present invention may eject droplets other than ink droplets. The recording medium is not limited a sheet of paper, and may be any given medium that can be subjected to recording.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A liquid droplet ejecting apparatus, comprising: a droplet ejection head which includes liquid passages having at their leading ends ejection openings which eject droplets, an ejection face which faces a recording medium onto which droplets ejected from the ejection openings are placed, and an actuator which applies energy to liquid inside the liquid passages; an absorber which includes a plurality of liquid absorbent facing portions, which face the ejection openings, respectively, when the absorber faces the ejection face; a moving mechanism which moves the droplet ejection head and the absorber relatively to each other such that the droplet ejection head and the absorber are positioned in an absorbing position where the ejection openings face the liquid absorbent facing portions, respectively; and a controller which controls the moving mechanism to position the droplet ejection head and the absorber in the absorbing position, and while controlling the moving mechanism to cause the droplet ejection head and the absorber to stop relatively to each other in the absorbing position, controls the actuator to apply to the liquid in the liquid passages energy falling short for droplet ejection from each of the ejection opening thereby having a meniscus formed on each of the ejection openings contact each of the liquid absorbent facing portions; and wherein, when more than N number of recording media are to be continuously recorded (where N is an integer of not less than 2), the controller controls the moving mechanism to position the droplet ejection head and the absorber in the absorbing position after completion of recording to the N-th recording medium and before performing recording to the (N+1) recording medium, and while controlling the moving mechanism to cause the droplet election head and the absorber to stop relatively to each other in the absorbing position, controls the actuator to apply to the liquid inside the liquid passages energy falling short for droplet ejection from each of the ejection openings thereby having a meniscus formed on each of the ejection openings contact each of the liquid absorbent facing portions.

2. The liquid droplet ejecting apparatus according to claim 1, wherein the ejection openings and the liquid-absorbent facing portion face each other with a gap therebetween, in the absorbing position.

3. The liquid droplet ejecting apparatus according to claim 2, wherein:

the absorber has a contact face which contacts the ejection face in the absorbing position; and in the absorbing position, the contact face contacts the ejection face, and the ejection openings and the liquid-absorbent facing portions face each other with the gap therebetween.

4. The liquid droplet ejecting apparatus according to claim 2, wherein:

the gap is formed by a recess formed on at least one of the absorber and a part of the ejection face including the ejection openings; and the controller controls the actuator to cause a meniscus formed on each of the ejection openings to project from the ejection opening by an amount greater than the depth of the recess.

5. The liquid droplet ejecting apparatus according to claim 1, wherein, in continuous recording, the controller performs the controls every time recording to the N number of recording media are completed.

6. The liquid droplet ejecting apparatus according to claim 1, wherein:

the controller controls the actuator to apply to the liquid in the liquid passages energy falling short for droplet ejection from each of the ejection openings, before recording is performed subsequently to powering on of the liquid droplet ejecting apparatus, and/or before recording is performed after a predetermined period of not performing any recording.

* * * * *